United States Patent [19]

Zipperian

[11] Patent Number: 4,971,731

[45] Date of Patent: Nov. 20, 1990

[54] METHOD AND APPARATUS FOR GENERATING MICROBUBBLES IN FROTH FLOTATION MINERAL CONCENTRATION SYSTEMS

[75] Inventor: Donald E. Zipperian, Tucson, Ariz.

[73] Assignee: Deister Concentrator Company, Inc., Fort Wayne, Ind.

[21] Appl. No.: 444,727

[22] Filed: Dec. 1, 1989

Related U.S. Application Data

[63] Continuation-in-part of Ser. No. 371,703, Jun. 26, 1989, which is a continuation-in-part of Ser. No. 260,813, Oct. 21, 1988, abandoned.

[51] Int. Cl.[5] ..... B01F 3/04

[52] U.S. Cl. ..... 261/81; 261/122; 261/DIG. 75; 209/170; 366/106

[58] Field of Search ..... 366/106; 261/81, 122, 261/DIG. 75; 209/170; 210/438

[56] References Cited

U.S. PATENT DOCUMENTS

| | | | |
|---|---|---|---|
| 1,677,265 | 7/1928 | Doving | 261/DIG. 75 |
| 3,256,802 | 6/1966 | Karr | 261/DIG. 75 |
| 3,397,871 | 8/1968 | Hasselberg | 261/DIG. 75 |
| 3,525,437 | 8/1970 | Kaeding et al. | 209/170 |
| 3,536,200 | 10/1970 | Gigliotti et al. | 210/438 |
| 3,545,731 | 12/1970 | McManus | 261/122 |
| 3,927,152 | 12/1975 | Kyrias | 261/122 |
| 4,118,447 | 10/1978 | Richter | 261/122 |
| 4,215,082 | 7/1980 | Danel | 261/124 |
| 4,230,569 | 10/1980 | Lohrberg et al. | 261/121.1 |
| 4,287,054 | 9/1981 | Hollingsworth | 209/170 |
| 4,565,660 | 1/1986 | Hultholm et al. | 366/106 |
| 4,735,709 | 4/1988 | Zipperian | 261/122 |
| 4,743,405 | 5/1988 | Durao et al. | 261/DIG. 75 |
| 4,769,119 | 9/1988 | Grundler | 204/149 |

FOREIGN PATENT DOCUMENTS

| | | | |
|---|---|---|---|
| 694918 | 7/1953 | United Kingdom | 261/122 |

*Primary Examiner*—Tim Miles

*Attorney, Agent, or Firm*—Pearne, Gordon, McCoy & Granger

[57] ABSTRACT

A method and apparatus for generating microbubbles in a flowing liquid stream for use in a froth flotation system. The system utilizes a microbubble generator having a tubular housing with an inlet end and an outlet end. Located coaxially within the housing is an inner member with an elongated, tapered, exterior surface. A porous tubular sleeve is mounted between the housing and the inner member coaxially therewith to define with the cylindrical interior surface of the housing an elongated air chamber of annular cross section. The porous sleeve has a cylindrical inner surface that defines with the exterior surface of the inner member an elongated liquid flow chamber of thin, annular cross section. An aqueous liquid is supplied to the liquid flow chamber at a relatively high flow rate and air under pressure is supplied to the air chamber so that air is forced radially inwardly through the porous sleeve to be diffused in the form of microbubbles in the flowing stream.

22 Claims, 7 Drawing Sheets

METHOD AND APPARATUS FOR GENERATING MICROBUBBLES IN FROTH FLOTATION MINERAL CONCENTRATION SYSTEMS

BACKGROUND OF THE INVENTION

CROSS REFERENCE TO RELATED APPLICATIONS

This application is a continuation-in-part of U.S. application Ser. No. 07/371,703, filed Jun. 26, 1989, which is a continuation-in-part of U.S. application Ser. No. 07/260,813, filed Oct. 21, 1988 (now abandoned).

This invention relates to the separation of minerals in finely comminuted form from an aqueous pulp by froth flotation, and especially to a froth flotation system with an improved means for introducing the gaseous medium in the form of minute bubbles into the liquid flotation column. More particularly, the invention relates to a device that is external to the column for generating gas bubbles in a flowing stream of aqueous liquid and delivering the bubble containing stream to the flotation column with a minimmum of bubble coalescence.

Commercially valuable minerals, for example, metal sulfides, apatitic phosphates, and the like, are commonly found in nature mixed with relatively large quantities of gangue materials. As a consequence, it is usually necessary to beneficiate the ores in order to concentrate the mineral content. Mixtures of finely divided mineral particles and finely divided gangue particles can be separted and a mineral concentrate obtained therefrom by widely used froth flotation techniques.

Froth flotation involves conditioning an aqueous slurry or pilp of the mixture of mineral and gangue particles with one or more flotation reagents which will promote flotation of either the mineral or the gangue constituents of the pulp when the pulp is aerated. The conditioned pulp is aerated by introducing into the pulp minute gas bubbles which tend to become attached either to the mineral particles or the gangue particles of the plup, thereby causing one category of these particles, a float fraction, to rise to the surface and form a froth which overflows or is withdrawn from the floatation apparatus.

The other category of particles, a non-float fraction, tends to gravitate downwardly through the aqueous pulp and may be withdrawn at an underflow outlet from the flotation vessel. Examples of flotation apparatus of this type are disclosed in U.S. Pat. Nos. 2,753,045; 2,758,714; 3,298,519; 3,371,779; 4,287,054; 4,394,258; 4,431,531; 4,617,113; 4,639,313; and 4,735,709.

In a typical operation, the conditioned pulp is introduced into a vessel to form a column of aqueous pulp, and aerated water is introduced into the lower portion of the column. An overflow fraction containing floated particles of the pulp is withdrawn from the top of the body of aqueous pulp and an underflow or non-float fraction containing non-floated particles of the pulp is withdrawn from the column in the lower portion.

In several systems of this type, the aerated water is produced by first introducing a frother or surfactant into the water and passing the mixture through an inductor wherein air is aspirated into the resulting liquid. In order to obtain the required level of aeration, a high flow ratte for the water must be maintained through the inductor. While recirculation systems have been devised to minimize the amount of "new" water added to the system, a significant expenditure in energy is required to move such large quantities of water.

Where the aerated water is generated externally of the vessel, the minute bubbles may tend to coalesce as they are conveyed to the vessel. This problem is aggravated by any change in velocity and/or pressure in the flowing stream. Coalescence reduces the number of minute bubbles and results in relatively large bubbles which are not as effective in floating the desired float fraction to the surface of the vessel.

The method and apparatus of the present invention, however, resolve the difficulties indicated above and afford other features and advantages heretofore not obtainable.

SUMMARY OF THE INVENTION

It is a general object of the present invention to provide a flotation aparatus for the concentration of minerals which optimizes the separation efficiency.

A further object of the invention is to provide a bubble generator adapted for use with a flotation column, which bubble generator is external to the flotation column and thus easily accessible for maintenance.

Another object is to provide a distribution system for bubbles so generated that maintains a minimum and uniform stream velocity so as to inhibit coalescence of the micronsize bubbles.

A further object is to provide such a distribution system with a uniform stream cross section from the generator to the outlet end.

In accordance with the present invention, minute bubbles or microbubbles are first generated in a flowing stream of aqueous liquid and then introduced into the flotation column. The system utilizes a microbubble generator having a tubular housing with an inlet end and an outlet end. Located coaxially within the housing is an inner member with an elongated, curved exterior surface.

A porous tubular sleeve is mounted between the housing and the inner member coaxially therewith to define with the cylindrical interior surface of the housing an elongated air chamber of annular cross section. The porous sleeve also has a cylindrical inner surface that defines, with the exterior surface of the inner member, an elongated liquid flow chamber of annular cross section.

An aqueous liquid is supplied through a fitting on the housing to the liquid flow chamber and is forced through the flow chamber at a relatively high flow rate and in an annular space to minimize the contact between the liquid and the inner surface of the porous sleeve. Air or other gas under pressure is supplied through another fitting on the housing to the air chamber so that air is forced radially inwardly through the porous sleeve and is diffused in the form of microbubbles in the flowing stream.

Because of the velocity of the flowing stream, the gaseous bubbles passing through the porous sleeve are sheared at the interior surface to produce very fine microbubbles. Accordingly, an aqueous liquid infused with minute gaseous bubbles is discharged from the outlet end of the housing and piped to the flotation vessel.

The inner member has a tapered form that tapers from the largest dimension near the inlet end of the flow chamber to a smaller dimension near the outlet end. Accordingly, the flow chamber has a progressively expanding transverse cross section. With this arrangement the air that is diffused into the flowing stream as it passes through the porous sleeve is added to the flow without substantially changing the rate of flow through the flow chamber. The increase in cross-sectional area of the flow passage is designed to progressively accommodate the increase in volume due to the infusion of air.

As another aspect of the invention, the lower end of the microbubble generator is provided with a distributor head with a plurality of ports that communicate with the lower end of the flow chamber. The ports are connected to individual conduits that convey the aerated mixture from the microbubble generator to the flotation column. The combined cross-sectional area of the outlet ports is just slightly less than the cross-sectional area of the lower end of the flow chamber. Accordingly, there is no fluid velocity decrease in the trasition zone at the lower end of the flow chamber to the individual conduits or in the individual conduits. This allows the microbubble generator to provide a flow to a plurality of streams without bubble coalescence.

In accordance with still another aspect of the invention, the individual conduits are in the form of flexible tubes that extend through fittings into the interior of the flotation column where they are free to flex in a whip-like fashion so as to increase the bubble distribution area. The resulting product is introduced into the flotation column through flexible tubes with discharge cross-sectional areas only slightly less than the tube cross-sectional area to maintain a pressure condition that prevents coalescence of the bubbles.

In accordance with still another aspect of the invention, the flotation vessel is provided with dual levels of aeration, one level being located somewhat above the bottom of the vessel, and the other level or upper level being located about halfway between the lower level and the top of the vessel. This arrangement permits the air system for one level to be shut down and serviced while the other level continues to operate, so that the servicing process does not require shutting down the vessel completely.

DESCRIPTION OF THE PREFERRED EMBODIMENTS

Figure 1:
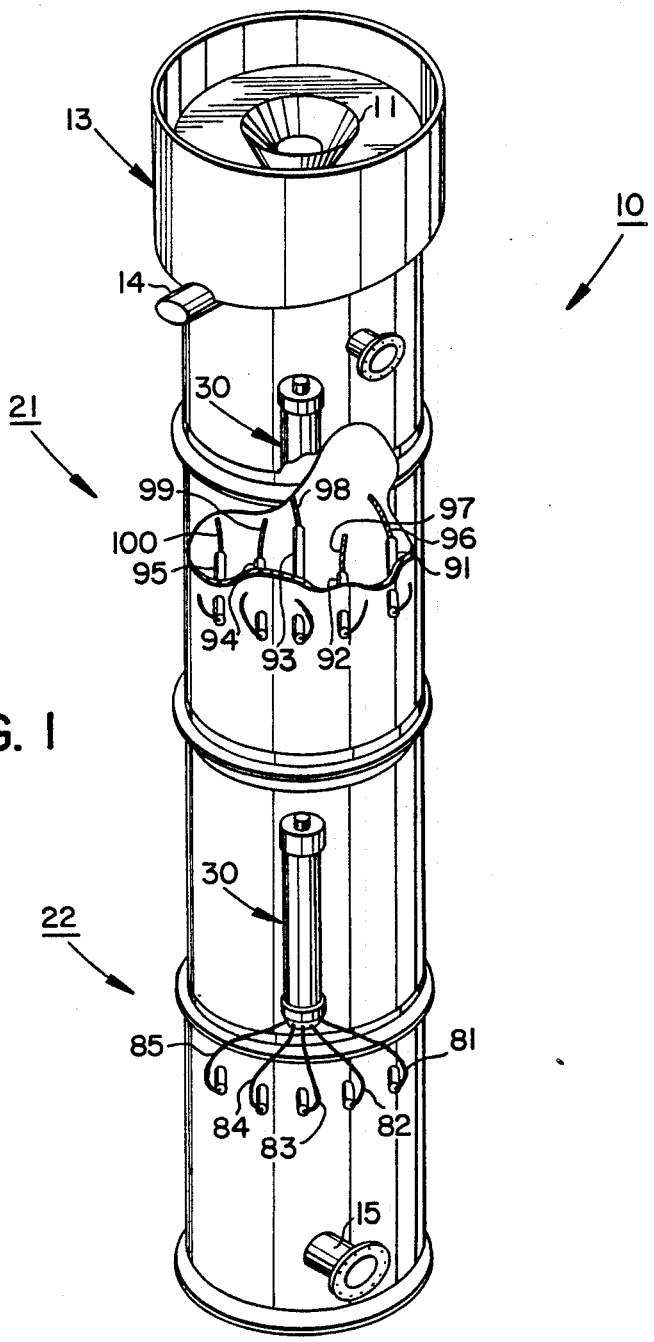
FIG. 1 is a perspective view of a preferred form of flotation vessel for use in a froth flotation system and having a means in accordance with the invention for introducing air in the form of minute bubbles into the aqueous slurry, with parts broken away for the purpose of illustration.
Figure 2:
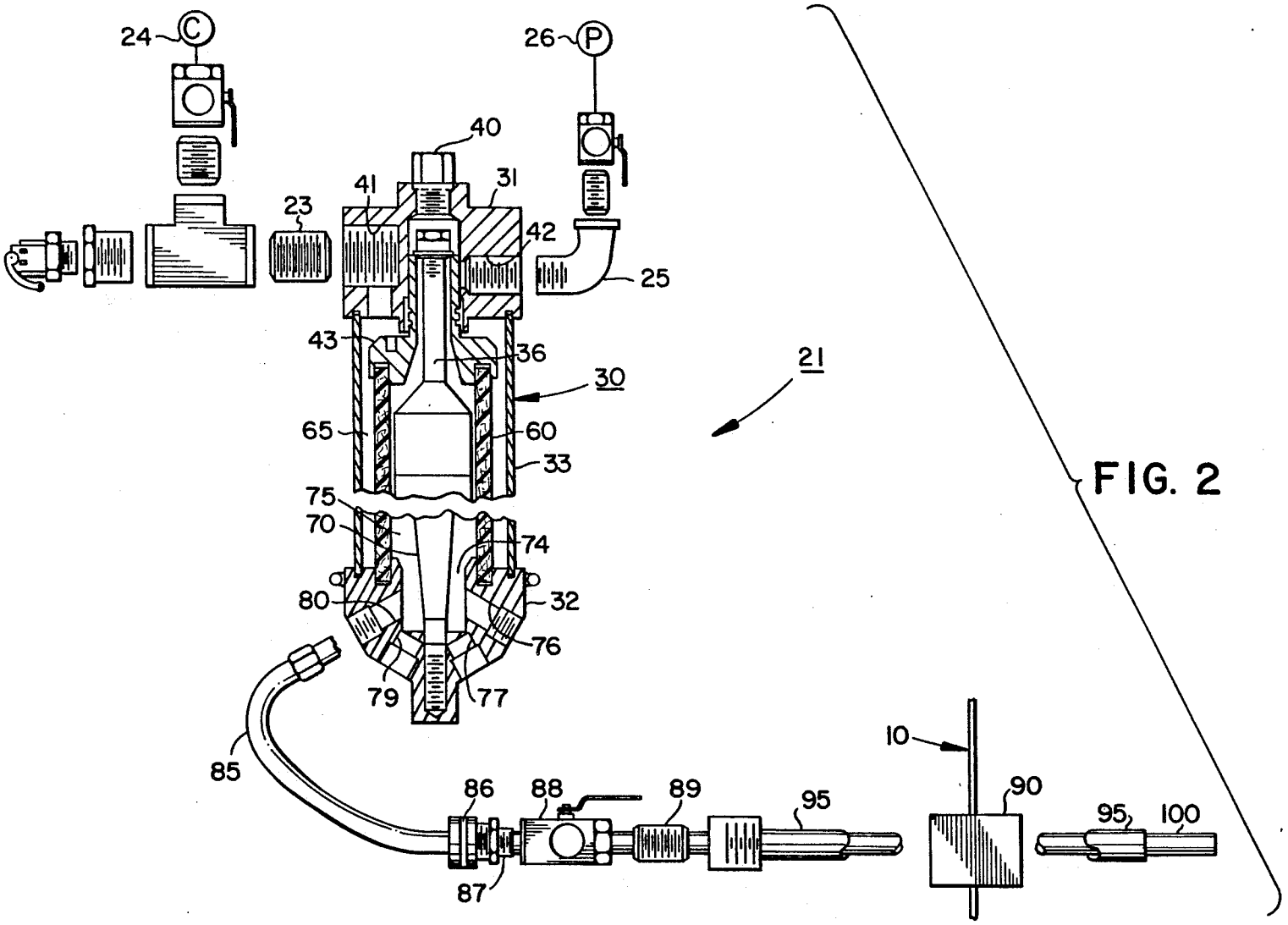
FIG. 2 is a partially exploded sectional view in somewhat diagrammtic form of one of the two air systems using a microbubble generator embodying the invention.
Figure 3:
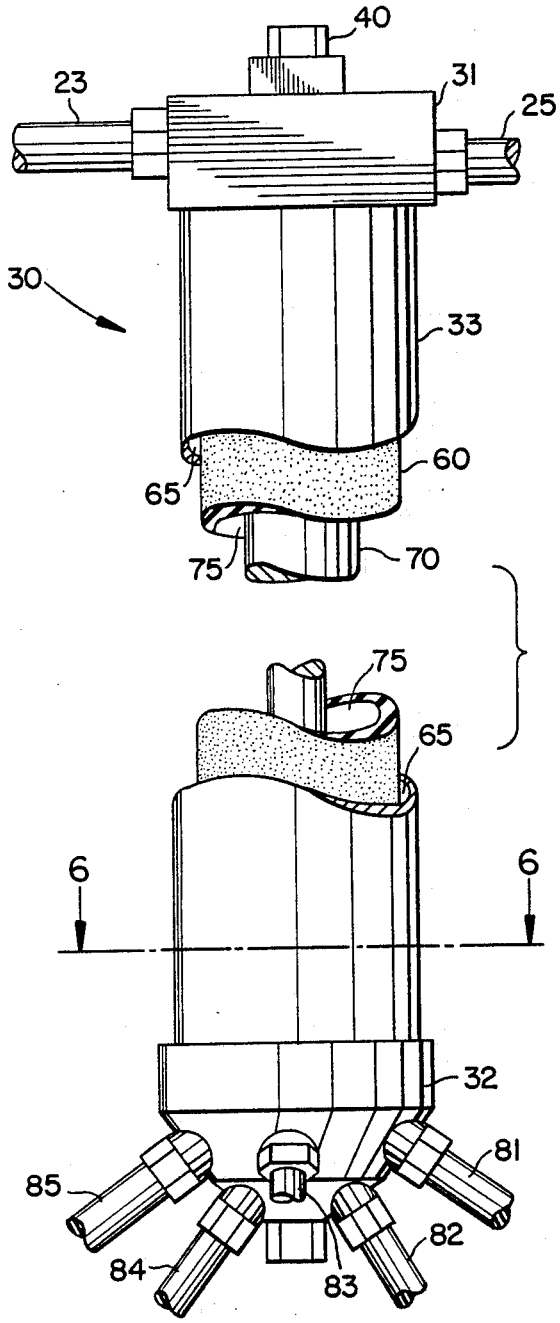
FIG. 3 is a fragmentary, broken elevational view on an enlarges scale of the microbubble generator of FIG. 2.
Figure 4:
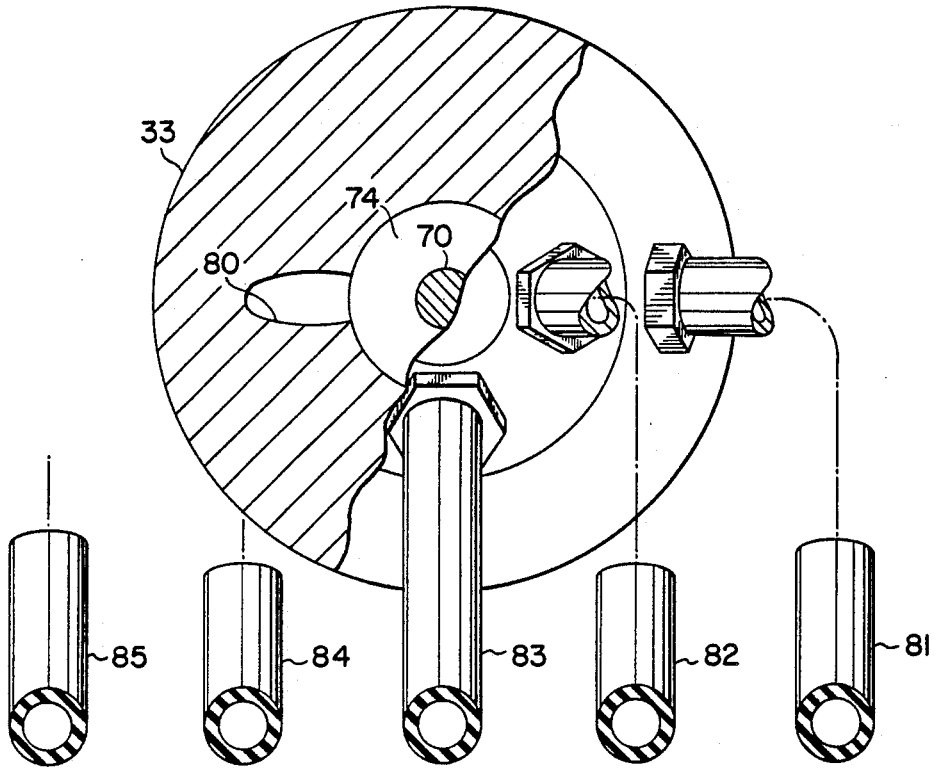
FIG. 4 is a lower end elevational view of the microbubble generator of FIG. 3 on an enlarged scale, with parts broken away and shown in section for the purpose of illustration.
Figure 5:
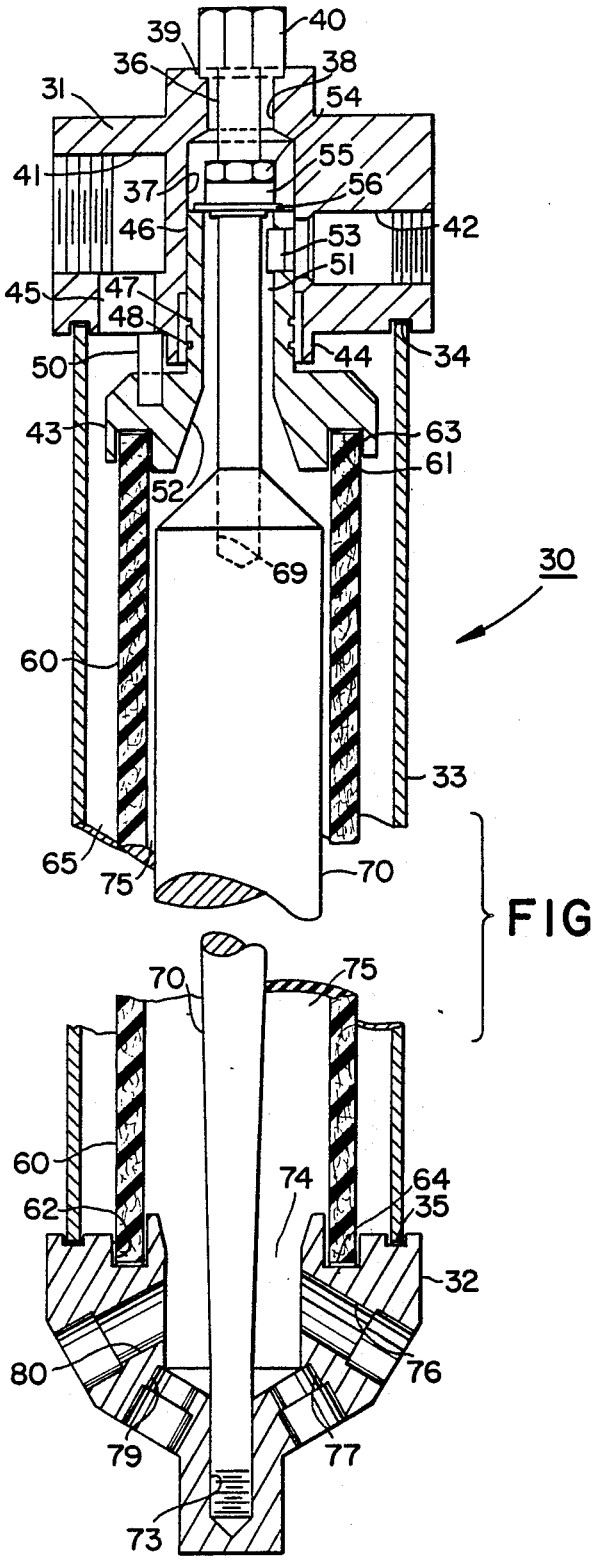
FIG. 5 is a fragmentary sectional view on an enlarged scale with the middle portion broken away showing the microbubble generator of FIG. 3.
Figure 6:
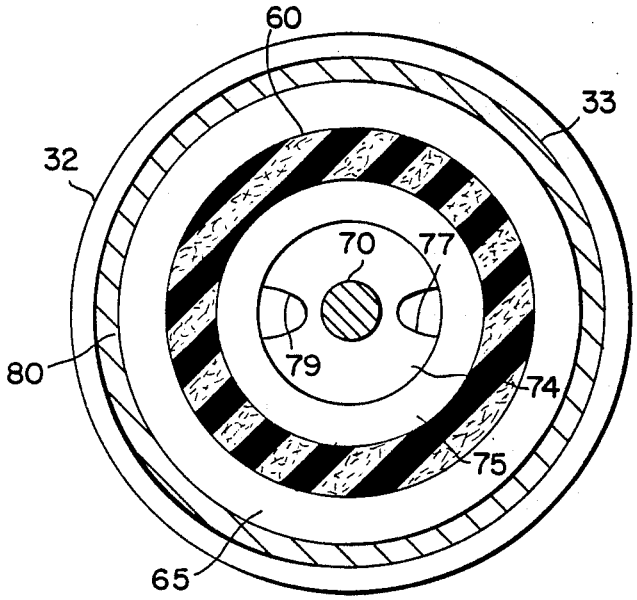
FIG. 6 is a sectional view on an enlarged scale, taken on the line 6-6 of FIG. 5.
Figure 7:
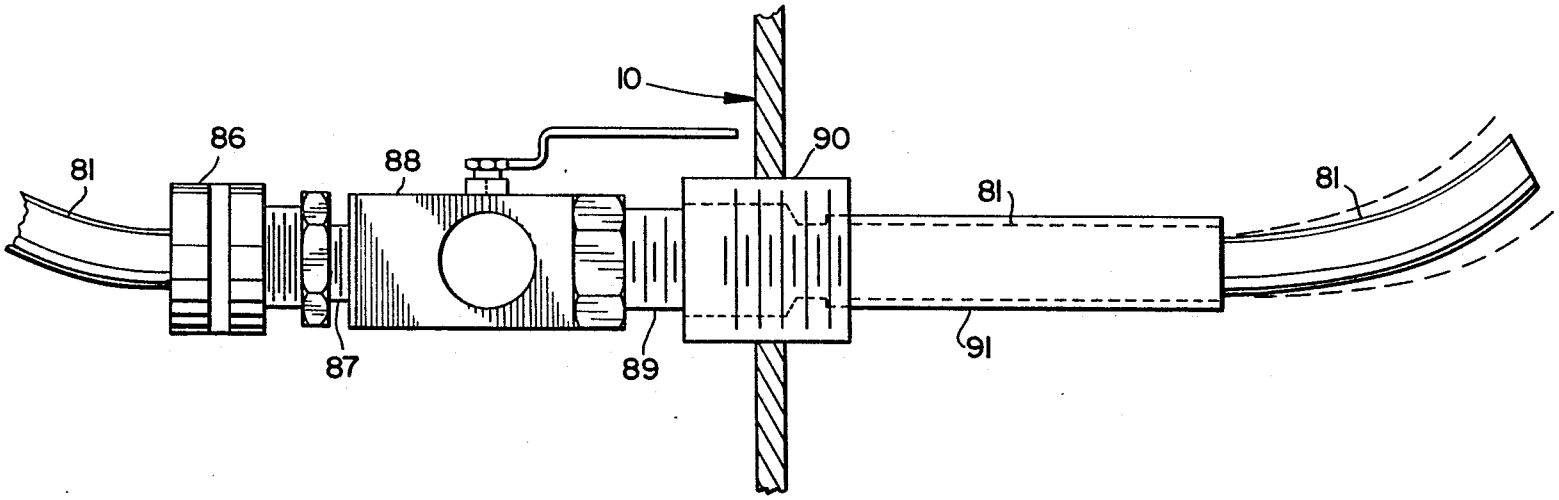
FIG. 7 is a fragmentary elevational view showing the connection to an insertion of one of the distributor tubes coming from the microbubble generator into the flotation column.

Referring more particularly to the drawings, and initially to FIG. 1, there is shown a fluid vessel or cylinder 10 for use in the separtion of minerals in finely comminuted form from an aqueous pulp by the froth flotation process and which utilizes an improved system in accordance with the invention for introducing gas in theform of minute bubbles into the liquid flotation column. The vessel includes a feed well 11 for feeding the agueous pulp into the upper end of the flotation column, the pulp being received through a feed tube from an external source of aqueous slurry to deliver a controlled quantity of the slurry to the feed well 11. The feed well 11 may include baffles (not shown) so that the aqueous slurry fed into the feed well becomes distributed throughout the flotation column.

The introductin of aerated water into the fluid vessel 10 is accomplished by means of a dual air system 21, 22 which provides two levels or aeration—one near the bottom of the vessel 10 and one about midway between the lower level and the top of the vessel. the aerated water that is introduced tends to flow upwardly through the aqueous slurry and the particulate matter suspended therein so that either the particles of the desired valuable mineral or the particles of the gangue suspended in the aqueous slurry adhere to the rising bubbles and collect at the upper end of the flotation column in the form of a froth. A launder 13 is provided at the upper end of the vessel 10 and is adapted to receive the froth which overflows from the top. An output conduit 14 is provided to convey the overflowing froth from the launder 13 to further processing or storage apparatus.

The solid matter not captured by the levitating gas bubbles gravitates downwardly through the aqueous slurry until it collects at the bottom of the column and is removed through an underflow duct 15.

The Air Systems - General Arrangement

The systems for introducing an aqueous mixture containing minute gas bubbles includes an upper system 21 and a lower system 22, each of which has a microbubble generator 30 formed in accordance with the invention. Gas under pressure is supplied to each of the microbubble generators 30 through an air inlet 23 that communicates with a compressor 24. An aqueous liquid is supplied to each microbubble generator 30 through a water inlet 25 which is connected to a pump 26 to provide the desired pressure and flow rate.

The upper air system 21 is essentially identical to the lower system 22 and, accordingly, like numerals are used to indicate like parts in the system components.

It has been found that the most effective arrangement comprises supplying about two-thirds of the aerated water through the lower system 22 and one-third through the upper system 21. Also, it is desirable that the tube sizes be selected to retain a uniform flow cross section through the length of the flow so as to maintain a uniform flow velocity

The Microbubble Generators

Each microbubble generator 30 is in the form of an elongated tube, typically about 48 inches long, and most of the components are fabricated of stainless steel. The generator includes an upper end member 31 and a lower end member 32 separated by an elongated, cylindrical, tubular housing 33. The upper end of the tubular housing 33 seats in an annular groove 34 formed in the adjacent face of the upper end member 31 and the lower end of the tubular housing 33 seats in an annular groove 35 formed in the adjoining face of the lower end member 32.

A threaded rod 36 extends through a central bore 37 in the upper end member 31, the bore having a narrowed throat portion 38. A cap nut 40, with an associated cap centering washer 39, is tightened down on the upper end of the rod 36 and seats in the throat portion 38. A radial air inlet port 41 and a radial water inlet port 42 are adapted to receive fittings that connect to air and water inlet lines, respectively. An inner fitting 43 seats against an annular axial extension 44 formed on the upper end member so that it does not block the bore 45 that communicates with the air inlet port 41.

An axially extending locator pin 50 extends into mating bores in the upper member 31 and in the inner fitting 43 to prevent relative rotation between the two parts.

An axially extending neck portion 46 of the inner fitting 43 extends upwardly into the axial bore 37. The lower portion of the neck 46 has a pair of spaced annular grooves 47 and 48 which receive seal rings. A central axial bore 51 is formed in the inner fitting 43, the bore being provided with a lower tapered portion 52. A tangential slot 53 is milled in the neck portion 46 adjacent the radial water inlet port 42 to provide a passage for water through the neck portion and into the central bore 51. the locater pin 50 assures that the tangential slot is directly aligned so that the water passage is not blocked.

A pair of jamb nuts 54 and 55 are threaded on the rod 36 midway between its ends at a location just above the neck portion 46. The nuts serve to lock themselves in a fixed position on the threaded rod 36 and they bear against a locater washer 56 that, in turn, bears against the upper end of the neck portion 46.

Located within the tubular housing 33 and coaxial therewith is a porous, tubular sleeve 60 that extends axially between the lower end member 32 and the inner fitting 43. The upper end of the sleeve 60 seats in an annular groove 61 formed in the inner fitting 43 and bears against an annular gasket 63 positioned in the groove 61. The lower end of the porous sleeve 60 seats in an annular groove 62 formed in the porous sleeve 60 seats in an annular groove 62 formed in the lower end member 32 and bears against an annular gasket 64 that is seated in the bottom of the groove 62.

In the present instance, the porous sleeve 60 is formed of a porous plastic material manufactured by Porex Technologies, of Fairburn, Ga. The material is a porous polypropylene and has a typical pore size of about 75 microns. The designation used by the manufacturer is POREX XM-1339. Other materials may be used, however, such as sintered stainless steel, porous ceramics, etc. The sleeve 60 is 2.925 inches O.D., and has a wall thickness of about 0.375 inch.

The exterior surface of the porous sleeve 60 and the interior surface of the tubular housing 33 define an elongated, annular air chamber 65 that communicates with the air inlet port 41. The lower end member 32 has a drain port 67 formed therein communicating with the air chamber 65 and an associated drain valve to drain off accumulated oil and particles when necessary.

The lower end of the threaded rod 36 is received in a threaded axial bore 69 formed in the upper end of a tapered flow control form 70 specially adapted for the present invention. The rod 70 tapers inwardly from a maximum diameter at the upper end thereof adjacent the upper end member 31 to a smaller diameter located adjacent the lower end member 32. The lower end of the tapered rod 70 is threaded and received in a threaded axial bore 73 formed in the lower end member 32.

Located above the threaded bore 73, and within the lower end member 32, in a transition chamber 74.

The exterior surface of the tapered flow control form 70 and the interior surface of the porous sleeve 60 define a fluid passage 75 that progressively increases in its annular cross section in the direction of flow from the upper end of the microbubble generator 30 to the lower end thereof. The progressively increasing cross section is designed to accommodate the progressive increase in the volume of the liquid/gas mixture as air is diffused into the flowing liquid through the porous sleeve 60. The infusion of the microbubbles results in more than doubling the volume as the flow progresses through the microbubble generator but, in accordance with the invention, the velocity remains roughly the same from one end of the generator to the other.

A plurality of discharge ports—in this case five—are formed in the lower end member 32 and all communicate with the transition chamber 74. The total cross-sectional area of the five discharge ports 76, 77, 78, 79, and 80 is designed to be slightly less than the maximum cross-sectional area of the annular flow passage 75 to avoid any fluid velocity decrease in the transition zone from the flow passage to the individual exit ports. Five flexible hoses 81, 82, 83, 84, and 85 are connected by threaded fittings to the respective discharge ports 76 through 80, respectively, to receive the aqueous fluid and convey it to the flotation column. Typical dimensions for the microbubble generator components and their relationship to the dimensions of the bases 81–85 are shown in Tabe I below.

TABLE I

| | | Microbubble Generator 30 (48" long) | | | | | |
|---|---|---|---|---|---|---|---|
| Housing 33 O.D./I.D. (inches) | Porous Tube 60 O.D./I.D. (inches) | Control Form 70 Max. O.D. (inches) | Control Form 70 Min. O.D. (inch) | Transition Chamber 74 Max. Area (sq. inches) | Outlet Hoses I.D. (inch) | Outlet Hoses Flow Area (sq. inch) | Total Area of Outlet Hoses (sq. inches) |
| 4/3.75 | 2.925/ 2.215 | 2 | .5 | 1.616 | .625 | .307 | 1.534 |

The hoses 81–85 all extend through fitting assemblies in the wall of the flotation column into the interior of the column, where the aqueous liquid is discharged from the end of the flexible hose directly into the column. The fitting assemblies at each instance include a compression fitting 86 tightly received around the hose, a connected fitting 87 between the compression fitting, a globe valve 88, and a short nipple 89 connected between the globe valve and the bushing 90 welded in place in the wall of the fluid vessel. The globe valve is turned to an open position and the hose extends completely through the bore in the globe valve.

Inside the flotation column, the hoses 81 through 85 extend through stainless steel guide tubes 91 through 95 of varying lengths adapted to position the ends of the hoses at a position to achieve uniform air distribution. The guide tubes may be curved as desired to acheive the desired distribution. The hose ends 96 through 100 extend substantially beyond the ends of the rigid guide tubes 91 through 95 (e.g., about 8 inches), and are free to flex in an oscillating fashion as the air-infused mixture is discharged therefrom into the flotation column.

This arrangement provides minimum resistance to the flow of the gas-infused liquid from the microbubble generator to the flotation column, and prevents coalescence of bubbles which would otherwise reduce the effectiveness of the flotation column.

The flexible hoses 81–85 are preferably formed of reinforced polymeric material. A suitable tubing is formed of polyethylene with a metal braid embedded therein, such as is commercially avaiable under the trade designation "TYCON."

By providing two levels of aeration in the flotation vessel, an improved performance is acheived. The second level helps to provide continuity of function and an improvement in flotation efficiency by the introduction of additional micron-size bubbles among those previously introduced at the lower level of aeration. The bubbles introduced at the lower level increase in size during their ascension in the flotation column, due to the decrease in fluid head pressure. The second level is typically located halfway between the lower aeration level and the top of the flotation compartment.

Another advantage of this arrangement is that when it is necessary to service one of the microbubble generators 30 or any of the associated air system components, only one of the two systems need to be shut down for maintenance, the other system being effective to keep the column in operation (albeit with some reduced efficiency) during the short period of time necessary for service on the other system. As indicated above, the supply hoses can all be completely removed from the flotation column using the unique coupling arrangement described above.

Operation

The operation of the system shown will be described with respect to a vessel 10 filled with a particular aqueous pulp containing a mixture of a valuable mineral and gangue and wherein it is desired to separate by froth flotation the valuable mineral in the froth at the top of the column. The froth containing the float fraction is removed through the launder 13.

During the process, the aqueous pulp will be fed at a controlled rate through the feed pip 12 into the feed well 11. Aerated water will be fed at a controlled rate through both the upper and lower distribution systems 21 and 22, the flow rate being about twice as great in the lower system as in the upper or intermediate system.

The process begins with the infusion of an aqueous liquid with microbubbles by means of the microbubble generators 30. Gas is supplied to the generators by the compressor 24 and water is supplied by means of the water pump 26 or head pressure, which pumps the water at a desired predetermined pressure. Recommended flow rates for various sizes of flotation cells are shown in tabular form in Table II below, it being understood that these are variable. For example, satisfactory operation has been acheived using less water and air at lower pressure, ranging as low as 40 psi.

TABLE II

| CELL DIA. | GENERATOR PSI (AIR) | AIR SUPPLY SCFM | GENERATOR PSI (WATER) | WATER SUPPLY GPM |
|---|---|---|---|---|
| 8" | 50 | 2 | 50 | .05 |
| 2.0' | 50 | 15 | 50 | .4 |
| 2.5' | 50 | 20 | 50 | .5 |
| 3.0' | 50 | 30 | 50 | .8 |
| 5.5' | 50 | 100 | 50 | 2.5 |
| 6.5' | 50 | 140 | 50 | 3.5 |
| 8.0' | 50 | 200 | 50 | 5.0 |
| 10.0' | 50 | 320 | 50 | 8.0 |
| 12.0' | 50 | 450 | 50 | 11.5 |

The gas, which may be air, for example, enters the microbubble generator 30 through the inlet port 41 and fills the air chamber 65 surrounding the exterior surface of the porous sleeve 60. The aqueous liquid, which is preferably water or brine mixed with a typical surfactant of the type well known in the art, is supplied through the radial port 42 and flows through the central passage 51 into the flow passsage 75, where it remains in continuous contact with the interior surface of the porous sleeve 60.

The gas pressure in the gas chamber 65 forces air through the small pores (i.e., about 75 microns in pore size) so that it emerges at the cylindrical interior surface of the sleeve, where it contacts the flowing aqueous liquid. Due to the relatively high velocity of the liquid flow, the bubbles are sheared from the surface as they emerge and become entrained in the form of minute bubbles in the flowing stream. As the flowing stream progresses from the inlet end to the outlet end of the microbubble generator, its volume is substantially increased, due to the infusion of gas. Accordingly, the flow chamber 75 increases progressively in size at a rate adapted to accommodate the increase in volume without resulting in an excessive increase in velocity or pressure. If pressure and flow velocity are not properly maintained, the minute bubbles may coalesce and be less effective in separating the desired float fraction from the aqueous pulp.

By the time the flowing stream has reached the lower end of the microbubble generator, an optimum volume of gas has been entrained in the stream in the form of minute bubbles and the resulting mixture exits through the five discharge ports 76 through 80. The individual stream then conveyed through the respective hoses 81 through 85 into the interior of the flotation column and the resulting liquid is then delivered from the open ends of the hoses into the interior of the column. The minute gas bubbles then levitate through the aqueous slurry in the flotation column and the particles of the desired valuable mineral adhere to the bubbles and collect at the upper end of the flotation vessel in the form of froth. The froth overflows into the launder 13, where it is collected and delivered to the output conduit 14, which conveys it away for further processing.

Using the well-understood principle that bubble-rise time diminishes with size diminution, the apparatus herein disclosed provides for greater efficiency in material recovery. Since bubble size is small, retention time within the water column is correspondingly large. The finer bubbles provide maximum surface area for attachment to descending particles. Turbulence within the water column is minimized whereby bubbles tend to follow only substantially vertical paths.

Two levels or elevations of distribution pipes are used, thereby creating two recovery zones within the column 10, one between the two levels and the other above the upper level. The lower level is two to four feet above the underflow duct 15 in the bottom of the column 10, while the upper level is disposed midway between the lower level and the upper end of the column 10.

In the upper recovery zone, bubbles from both levels will obtain. In the lower zone, the only bubbles will be those from the lower level. Thus, bubble density is correspondingly different in the two zones. Bubbles in the upper zone, being more concentrated, attach to and immediately float off that particle fraction most susceptible to float separation. The remaining particles descend through the lower zone where the fine bubbles are ascending relatively slowly, the slow ascent creating more time during which attachment to descending particles may occur. Primary recovery, therefore, may be said to occur in the upper zone, and scavenging in the lower zone.

Of importance is the fact that bubble generation and sizing are external to the column 10 and that the same size bubbles are fed to both of the upper and lower sets of pipes. Since rising bubbles progressivly expand in size, those bubbles introduced at the lower level will enlarge by the time they reach the upper level. Thus, some of the desired qualities of tiny bubbles will there be lost. However, tiny bubbles are introduced at the upper level and will rise vertically, providing maximum surface area for particle attachment. Thus, by means of multilevel bubble introduction of externally generated bubbles, bubble size is maintained optimally small, thereby enhancing the probability of particle attachment.

Tiny bubble introduction at the different levels also minimizes turbulence within the column water. Smaller bubbles tend to create less disturbance and to follow vertical paths. Thus, there will be minimal turbulence in the lower zone, as bubble size is small. In the upper zone where bubble concentration is greater, the distance to the water surface is relatively short and the introduction of small bubbles tends to infiltrate smaller bubbles with the enlarged ones and ascendancy remains substantially vertical. Turbulence in the form of circular motion or boiling action is thereby minimized, contributing further to the efficiency of material pick-up. The two levels of distributor pipes at the two levels, receiving and emitting the same size bubbles, inhibit development of turbulence, thereby enhancing column efficiency.

While air and water are preferred in the working embodiments of this invention, gases other than air, such as nitrogen, and liquids other than water may be used. Thus, the words "air" and "water" and the term "aerated water" are intended to include these equivalents.

In the present invention, generation of microsized bubbles enhances the efficiency of the flotation mechanism through increased surface area of the bubbles while reducing the air volume requirements typical of present flotation mechanisms. The system requires lower air and water pressures (35–50 psig) and lower water volume (0.15 GPM/SCFM) than other microbubble systems, which usually require a minimum of 80 psig air and water pressure and water requirements of at least 3 GPM/SCFM.

While the invention has been shown and described with respect to specific embodiments thereof, this is intended for the purpose of illustration rather than limitation, and other variations and modifications of the specific method and apparatus herein shown and described will be apparent to those skilled in the art, all within the intended spirit and scope of the invention. Accordingly, the patent is not to be limited in scope and effect to the specific embodiments herein shown and described, nor in any other way that is inconsistent with the extent to which progress in the art has been advanced by the invention.

What is claimed is:

1. An apparatus for supplying a mixture of gaseous bubbles and liquid for use in a froth flotation mineral concentration system that includes a tank that holds a froth flotation column, a microbubble generator external to the tank and having a distributor associated therewith for dividing a single fluid flow passage into at least three separate fluid outlet passages and a plurality of fluid conduits for transmitting said fluid mixture from said microbubble generator to said froth flotation column, said microbubble generator comprising:

a tubular housing with an inlet end and an outlet end;

a coaxial inner member located within said housing;

a porous tubular sleeve mounted between said housing and said inner member and coaxial therewith, said sleeve having an outer surface that defines with said interior surface of said housing, an elongated gas chamber of annular cross section, and an inner surface that defines with said exterior surface of said inner member, an elongated liquid flow chamber of annular cross section;

means for supplying an aqueous liquid to said liquid flow chamber;

means for supplying gas under pressure to said gas chamber whereby gas is forced radially inwardly through said porous sleeve and is diffused in the form of microbubbles in said flowing stream so that an aqueous liquid infused with air is discharged from the outlet end of said flow chamber;

means defining a transition chamber communicating with the outlet end of said flow chamber and wherein the flow is divided from a single flow passage at the inlet end into a plurality of separate flow passages at the outlet thereof, said transition chamber providing a generally uniform cross-sectional area for the flow, the combined cross-sectional area of said separate flow passages at said outlet being slightly less than the minimum cross-sectional area of the transition chamber; and a plurality of flexible hoses, one for each of said separate flow passages, communicating from said outlet end of said housing to the interior of said flotation column.

2. Apparatus as defined in claim 1, wherein the end portions of said tubes located in the interior of said air-infused mixture is discharged therefrom into the flotation column.

3. Apparatus for generating gaseous bubbles in a flowing liquid stream for use in a froth flotation system, comprising:

a tubular housing with an inlet end and an outlet end and having an elongated interior surface;

a coaxial inner member located within said housing and having an elongated tapered exterior surface that diminishes in section from the inlet end to the outlet end;

a porous tubular sleeve mounted between said housing and said inner member and coxial therewith, said sleeve having an outer surface that defines with said interior surface of said housing, an elongated gas chamber of annular cross section, and an inner surface that defines with said exterior surface of said inner member, an elongated liquid flow chamber of annular cross section that increases progressively from said inlet end to said outlet end;

means operatively associated with said housing for supplying an aqueous liquid to said liquid flow chamber and for flowing said liquid through said liquid chamber in an axial direction from said inlet end to said outlet end;

means operatively associated with said housing for supplying gas under pressure to said air chamber whereby gas is forced radially inwardly through said porous sleeve and is diffused in the form of microbubbles in said flowing stream so that an aqueous liquid infused with air is discharged from said outlet end of said flow chamber; and distributor means at the outlet end of said flow chamber and defining an enclosed transition chamber with an inlet end and an outlet end wherein the flow is divided from a single flow passage at the inlet end into a plurality of separate flow passages at the outlet end thereof, the cross-sectional area of the transistion chamber decreasing slightly from the inlet end to the outlet end.

4. Apparatus as defined in claim 3, wherein said porous sleeve is fomred of porous polypropylene plastic.

5. Appartus as defined in claim 3, wherein said porous sleeve has pores formed therein with an average pore size of about 5–100 microns.

6. Apparatus as defined in claim 3, wherein said porous sleeve has a tubular cylindrical form.

7. Apparatus as defined in claim 6, wherein said porous sleeve has a wall thickness of about 0.2 to 0.4 inch.

8. Apparatus as defined in claim 3, wherein the gas pressure maintained in said gas chamber is about 40–70 psi.

9. Apparatus as defined in claim 8, wherein the supply pressure used to move said aqueous liquid through said flow passage is about 40–70 psi.

10. Apparatus as defined in claim 3, wherein the maximum cross-sectional area of said flow chamber at the downstream end thereof is at least twice the minimum cross-sectional area of said flow chamber at the upstream end.

11. Apparatus as defined in claim 3, wherein the combined cross-sectional area of the separate flow passage is slightly less than the minimum cross-sectional area of the transition chamber.

12. Apparatus as defined in claim 3, further including a plurality of flexible hoses, one for each of said separate flow passages, communicating from said outlet end of said housing to a flotation column of said froth flotation system, said hoses extending into the interior of said flotation column.

13. Apparatus as defined in claim 12, wherein the end portions of said hoses located in the interior of said column are free to flex in an oscillating fashion as the air-infused mixture is discharged therefrom into the flotation column.

14. A method for generating microbubbles in a flowing stream for use in a froth flotation system, comprising:

introducing air under pressure into a closed chamber defined in part by the exterior surface of a porous tubular sleeve;

pumping a stream of aqueous liquid through a flow passage defined in part by the interior surface of said porous sleeve and in part by an elongated inner member located within said porous sleeve and having a tapered, generally conical, outer surface with a lateral cross section that diminishes from the inlet end to the outlet end of said flow passage so that said flow passage has a generally annular cross section that increases progressively in the direction of flow;

whereby gas is forced radially inwardly through said porous sleeve and is diffused in the form of microbubbles in said flowing stream so that the cross section of the stream increases to accomodate the increased volume resulting from the infusion of air into the aqueous liquid;

dividing said flowing stream in a transition chamber at said outlet end of said flow passage into a plurality of separate flowing streams, wherein said transition chamber provides a generally uniform cross section for the flow and the combined cross-sectional area of said separate flowing streams is slightly less than the minimum cross-sectional area of the transition chamber; and conveying ech of said separate flowing streams to a froth flotation column by means of flexible tubes that extend into the interior of said flotation column.

15. A method as defined in claim 14, wherein said porous sleeve is formed of polypropylene plastic.

16. A method as defined in claim 14, wherein said porous sleeve has pores formed therein with an average pore size of about 5–100 microns.

17. A method as defined in claim 14, wherein said porous sleeve has a tubular cylindrical form.

18. A method as defined in claim 17, wherein said porous sleeve has a wall thickness of about 0.2 to 0.04 inch.

19. A method as defined in claim 14, wherein the gas pressure maintained in said closed chamber is about 40–70 psi.

20. A method as defined in claim 19, wherein the supply pressure used to pump said aqueous liquid through said flow passage is about 40–70 psi.

21. A method as defined in claim 14, wherein the end portions of said tubes located in said column are free to flex in an oscillating fashion as the air-infused mixture is discharged therefrom into the flotation column.

22. An apparatus for supplying a mixture of gaseous bubbles and liquid for use in a froth flotation system that includes a vessel containing a froth flotation column, said apparatus comprising:

a microbubble generator having a tubular housing with an inlet end and an outlet end;

a coaxial inner member located within said housing and having an elongated tapered exterior surface that diminishes in section from the inlet end to the outlet end;

a porous tubular sleeve mounted between said housing and said inner member and coaxial therewith, said sleeve having an outer surface that defines with said housing an elongated gas chamber of annular cross section and an inner surface that defines said exterior surface of said inner member an elongated liquid flow chamber of annular cross section that increases progressively from said inlet end to said outlet end;

means for supplying an aqueous liquid to said flow chamber;

means for supplying gas under pressure to said gas chamber whereby gas is forced radially inwardly through said porous sleeve and is diffused in the form of microbubbles in said flowing stream so that an aqueous liquid infused with air is discharged from the outlet end of said flow chamber; and distributor means at the outlet end of said flow chamber and defining an enclosed transition chamber with an inlet end and an outlet end wherein the flow is divided from a single flow passage at the inlet end into a plurality of separate flow passages at the outlet end thereof, the cross-sectional area of the transition chamber decreasing slightly from the inlet end to the outlet end; and a plurality of flexible tubes, one for each of said separate flow passages for conveying said fluid mixture to the interior of said flotation column, the open discharge ends of said tubes being free to flex in an oscillating fashion as the air-infused mixture is discharged therefrom into the flotation column.

* * * * *

UNITED STATES PATENT AND TRADEMARK OFFICE

CERTIFICATE OF CORRECTION

PATENT NO. : 4,971,731

DATED : November 20, 1990

INVENTOR(S) : Zipperian

It is certified that error appears in the above-identified patent and that said Letters Patent is hereby corrected as shown below:

Column 11, Claim 2 should read as follows:

--Apparatus as defined in claim 1, wherein the end portions of said tubes located in the interior of said columns are free to flex in an oscillating fashion as the air-infused mixture is discharged therefrom into the flotation column.--

Column 11, line 64, delete "passage" and insert --passages--.

Signed and Sealed this

Fifth Day of May, 1992

*Attest:*

DOUGLAS B. COMER

*Attesting Officer*

*Acting Commissioner of Patents and Trademarks*